US011684960B2

(12) United States Patent
Galli et al.

(10) Patent No.: US 11,684,960 B2
(45) Date of Patent: Jun. 27, 2023

(54) PLANT FOR EXTRUDING METALS COMPRISING A SYSTEM OF PULLERS WITH SINGLE DIRECTION GUIDES

(71) Applicant: DANIELI & C. OFFICINE MECCANICHE S.p.A., Buttrio (IT)

(72) Inventors: Alessandro Mario Galli, Costa Masnaga (IT); Mattia Merlini, Brescia (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 16/754,091

(22) PCT Filed: Oct. 15, 2018

(86) PCT No.: PCT/IB2018/057968
§ 371 (c)(1),
(2) Date: Apr. 6, 2020

(87) PCT Pub. No.: WO2019/073457
PCT Pub. Date: Apr. 18, 2019

(65) Prior Publication Data

US 2020/0331047 A1 Oct. 22, 2020

(30) Foreign Application Priority Data

Oct. 13, 2017 (IT) ..... 102017000115517

(51) Int. Cl.
*B21C 35/02* (2006.01)
*B21C 1/30* (2006.01)

(52) U.S. Cl.
CPC ..... *B21C 35/02* (2013.01); *B21C 1/30* (2013.01)

(58) Field of Classification Search
CPC ..... B21C 35/00; B21C 35/02; B21C 1/16; B21C 1/27; B21C 1/30; B21C 1/305; B21D 43/285
(Continued)

(56) References Cited

U.S. PATENT DOCUMENTS 4,873,857 A * 10/1989 Giancarlo ..... B21C 35/02 72/257
5,201,209 A * 4/1993 Houmura ..... B21C 35/02 72/257

FOREIGN PATENT DOCUMENTS

EP 0 291 734 11/1988
FR 1 306 692 10/1962
(Continued)

OTHER PUBLICATIONS

Patent Cooperation Treaty, International Search Report and Written Opinion for International Application No. PCT/IB2018/057968, dated Feb. 19, 2019, 14 pages.

*Primary Examiner* — Shelley M Self
*Assistant Examiner* — Jared O Brown
(74) *Attorney, Agent, or Firm* — Stetina Brunda Garred and Brucker

(57) ABSTRACT

A system of pullers, in particular for extruding metals, the system comprising at least a first puller and a second puller, each equipped with gripping means adapted to engage and grip an end portion of a profile, in particular of an extruded profile exiting from an extrusion press, the system comprising a first guide and a second guide, where the at least two, first and second, pullers can be translated along the first and second guides, where the first guide is dedicated to the translation of both the at least two, first and second, pullers in a single first translation direction, and where the second guide is dedicated to the translation of both the at least two,
(Continued)

first and second, pullers in a second translation direction opposite to the first translation direction.

15 Claims, 2 Drawing Sheets

(58) Field of Classification Search
USPC ..... 72/257
See application file for complete search history.

(56) References Cited

FOREIGN PATENT DOCUMENTS

| | | | | | |
|---|---|---|---|---|---|
| JP | S5231721 | | | 7/1977 | |
| JP | S53124329 | | | 10/1978 | |
| JP | 55048417 | A | * | 4/1980 | ..... B21C 35/02 |
| JP | 02274309 | A | * | 11/1990 | |
| JP | H02 299717 | | | 12/1990 | |
| JP | H05 261430 | | | 10/1993 | |

* cited by examiner

PLANT FOR EXTRUDING METALS COMPRISING A SYSTEM OF PULLERS WITH SINGLE DIRECTION GUIDES

CROSS-REFERENCE TO RELATED APPLICATIONS

The present application claims priority to PCT International Application No. PCT/IB2018/057968 filed on Oct. 15, 2018, which application claims priority to Italian Patent Application No. 102017000115517 filed Oct. 13, 2017, the entirety of the disclosures of which are expressly incorporated herein by reference.

STATEMENT RE: FEDERALLY SPONSORED RESEARCH/DEVELOPMENT

Not applicable.

TECHNICAL FIELD

The present invention falls within the field of moving metal objects. In particular, the present invention falls within the field of moving extrusion products exiting from an extrusion press. More specifically, the present invention falls within the field of moving metal profiles, for example exiting from an extrusion press. In detail, the present invention relates to a system of pullers for moving in traction metal profiles, for example but not exclusively metal profiles exiting from an extrusion press. In greater detail, the present invention relates to a system of the aforesaid type provided with an innovative solution for moving at least two pullers with which the system is provided.

BACKGROUND ART

There are known in the field of metallurgy, in particular in the field of extruding metals by means of an extrusion press, traction systems or systems of "pullers" used in particular for moving in traction profiles exiting from an extrusion press.

The systems according to the prior art comprise at least two pullers, each provided with gripping means adapted to engage and grip the end portion of a profile extruded by means of an extrusion press, where both pullers can be translated along dedicated guides adapted to the purpose, alternatively approaching the press and moving away from the press, where the methods of using the systems of known type may be summarized as follows. With a first puller at the extrusion press, the gripping means of said first puller are operated so as to engage and grip the end portion of the profile exiting from the extrusion press. Then, the first puller is translated along its guide away from the press so as to exert the desired traction (or pulling) on the profile, thereby promoting the exit from the press. Simultaneously, the second puller is translated along its guide, which is different from that of the first puller, approaching the extrusion press. When the first puller reaches its stroke end position far from the press, the gripping means are operated so as to cease the grip on the end portion of the profile, where in the meantime, the second puller has reached its stroke end position close to the press. At this point, the gripping means of the second puller are operated so as to engage and grip the end portion of the profile (which in the meantime was conveniently cut), and the second puller is moved away from the press, while the first puller is moved to approach the press again. The cycle therefore continues alternating the two pullers according to the methods summarized above, where the operating steps of both pullers are also defined as "pulling" or active step (away from the press) and "return" step (approaching the press), respectively.

Document EP0291734 describes another system of pullers which provides a loop guide comprising two parallel rectilinear stretches connected through curved connections. The puller which drags the extruded profile away from the press moves along a first stretch. Simultaneously, the other puller instead travels the second stretch, approaching the press. The curved connections allow the movement of the pullers between one rectilinear stretch of the guide to the other. This movement principle is also suggested in the technical solution described in FR 1,306,692.

Document JP H02 299717 describes a further technical solution in which there are provided two guides, one for moving pullers away from the press, the other for approaching the pullers. The two guides are arranged in overlapping position. At the end of the travel, along one of the upper or lower guides, the corresponding puller is transferred to the other guide through a vertical moving system which raises or lowers the puller, as the case may be.

The systems according to the prior art of the type summarized above however are affected by several drawbacks and/or disadvantages which the present invention intends to overcome or at least minimize.

Firstly, it is worth noting that in the systems according to the prior art having "dedicated guides", each of the two pullers is translated along the guide dedicated thereto (always the same) during both the "pulling" and "return" steps, that is to say in both the translation directions away from the press and approaching the press, respectively.

This results in the need to prepare solutions adapted to avoid and prevent the mutual interference between the two pullers during the respective pulling and return steps, in particular the interference between the respective gripping means, where according to the solutions most commonly implemented, the gripping means of the puller in return step are moved (translated vertically and/or transversely) to avoid them from interfering with the puller in the pulling step. Said solutions thus inevitably result in an increase of the costs and are also subject to breakdowns and wear.

Moreover, again according to the solutions most commonly implemented, in order to simplify the construction of the carriages of the pullers, the guides (also called in lanes) are positioned one on the ground and one suspended by means of a suitable bridge structure, or are suspended one beside the other above the extrusion line. Moreover, the support structure, in particular both that for the suspended guide (if one alone) and that common to the two guides (if both suspended), inevitably results in a transmission of the vibrations between the two guides or travel paths, with a negative repercussion on the quality of the extruded profile.

Moreover, from a constructional viewpoint, both guides are to necessarily be substantially identical since the two pullers on both guides both perform the pulling and return steps. Contrarily from a constructional viewpoint, the two pullers are to necessarily be different from each other to avoid the problems of mutual interference summarized above; moreover, the diversity of the pullers makes them poorly interchangeable and requires dedicated designs, also in this case with an inevitable increase of the costs. Moreover, one and only one puller may be translated along each guide, where contrarily the possibility of using a greater number of pullers would allow speeding up the extrusion process.

The systems of pullers with loop guide indicated above have the disadvantage of being particularly bulky due to the connection curves required to move each puller between the two rectilinear stretches. These curves cause a change of orientation of the puller in the passage between one rectilinear stretch and the other. This results in the need to leave an ample maneuvering space about the loop guide to allow the pullers a free movement along the various parts forming the guide itself. Ultimately, the plant installation and management costs increase.

Another drawback of the systems with loop guide is revealed in the undesired transmission of the vibrations between the two rectilinear stretches along which the two pullers slide at the same time. In particular, the stretch, along which the puller that drags the profile, suffers the vibrations generated by the puller returning towards the press.

In reference instead to the technical solution described in JP H02 299717, the most critical aspect is the use of a vertical transfer system of the pullers made necessary by the overlapping configuration of the two guides. Such a system is to be configured to grasp the pullers at the end of one of the two guides and to move them, by raising them or lowering them, up to the corresponding end of the other guide. The use of a vertical transfer system affects the installation costs and significantly complicates managing the plant.

Simultaneously, the overlapping guide configuration significantly affects the complexity of the plant, especially in reference to the installation of the upper guide which requires a suitable support structure.

SUMMARY

It is therefore the object of the present invention to overcome or at least minimize the drawbacks founded in the solutions according to the prior art, in particular in the multiple-connection fastening assemblies.

In particular, it is an objective or object of the present invention to achieve a solution which allows manufacturing and using constructively different guides, in particular a constructively simplified one, and therefore which is designed, installable and usable at lower costs with respect to the other one.

Moreover, it is an object of the present invention to provide a solution which allows using substantially identical pullers and therefore all ascribable to a common design, with significant advantages in terms of design, production, installation and usage costs.

It is a further object of the present invention to allow or at least improve the interchangeability of the pullers, thus promoting and facilitating the replacement as well as the maintenance thereof, for example in case of failure.

It is also one of the objects of the present invention to allow the use of a number of pullers which is at least two, and therefore being capable of adapting the number of pullers to the particular needs and/or circumstances.

For this purpose, there is described below an embodiment of the present invention by means of which the above objects are at least partially achieved.

The present invention is based on the general consideration according to which the preset objects summarized above may be effectively achieved by means of a system of pullers in which each guide is of the "one way" type, and this where each of the pullers along each guide is translated in a sole translation direction, that is to say either approaching the press or moving away from the press (in the particular but non-limiting case of a system of pullers dedicated to an extrusion press). According to the consideration summarized above, each guide practically is dedicated to one and only one operating step of the pullers, where each puller on a predetermined guide performs one and only one operating step, and therefore either a "pulling" step or a "return" step.

In consideration of the disadvantages encountered in the solutions according to the known art and of the objects summarized above, as well as of the above, according to the invention, a system of pullers, in particular for extruding metals, is proposed. Said system comprising at least a first puller and a second puller, each equipped with gripping means adapted to engage and grip an end portion of a profile, in particular of an extruded profile exiting from an extrusion press, said system comprising a first guide and a second guide, where said at least two, first and second, pullers can be translated along said first and second guides where said first guide is dedicated to the translation of both said at least two, first and second, pullers in a single first translation direction, and where said second guide is dedicated to the translation of both said at least two, first and second, pullers in a second translation direction opposite to said first translation direction. According to the invention, said at least two, first and second, pullers can be translated along substantially parallel directions along said first and second guides. Moreover, the system of pullers comprises means for repositioning both said at least two pullers from said first guide to said second guide and from said second guide to said first guide.

The system of pullers according to the invention is also characterized in that said guides are separate from each other, are not overlapping and are both anchored to the ground on the same side with respect to an extrusion line along which the profile is extruded, that is to say along which the same profile is dragged by one of said pullers.

According to one embodiment, the two guides have the same height with respect to a substantially horizontal reference plane.

According to one embodiment, said system comprises a third parking guide intended to house at least one of said pullers in a stopped status and so as not to hinder the translation of the remaining one or more pullers along said first and second guides.

According to one embodiment, said repositioning means comprise at least a fourth repositioning guide which can be repositioned alternatively between a first position at a first end portion of said first guide and a second position at a first end portion of said second guide adjacent to said first end portion of said first guide, where said at least two, first and second, pullers can be translated both along said first guide and along said fourth repositioning guide with said fourth repositioning guide in said first position, and where said at least two, first and second, pullers can be translated both along said second guide and along said fourth repositioning guide with said fourth repositioning guide in said second position.

According to one embodiment, said repositioning means comprise at least a fifth repositioning guide which can be repositioned alternatively between a first position at a second end portion of said first guide and a second position at a second end portion of said second guide adjacent to said second end portion of said first guide, where said at least two, first and second, pullers can be translated both along said first guide and along said fifth repositioning guide with said fifth repositioning guide in said first position, and where said at least two, first and second, pullers can be translated both along said second guide and along said fifth repositioning guide with said fifth repositioning guide in said second position.

According to one embodiment, said fourth and fifth repositioning guides can be translated along a translation direction which is different from the extension direction of said first and second guides.

According to one embodiment, both said two first and second guides are intended and shaped to be anchored to the ground.

According to one embodiment, each of said at least two first and second pullers comprises a main frame or carriage, where each of said at least two, first and second, pullers comprises means for moving said gripping means with respect to said main frame or carriage.

The present invention also relates to a plant for extruding metals, in particular metal profiles, said plant being equipped with a system of pullers according to one of the embodiments of the present invention.

Further possible embodiments of the present invention are defined by the claims.

BRIEF DESCRIPTION OF THE DRAWINGS

In the drawings.

The same numbers and the same reference letters in the figures identify the same elements or components.

DETAILED DESCRIPTION OF THE PRESENT INVENTION

Figure 1:
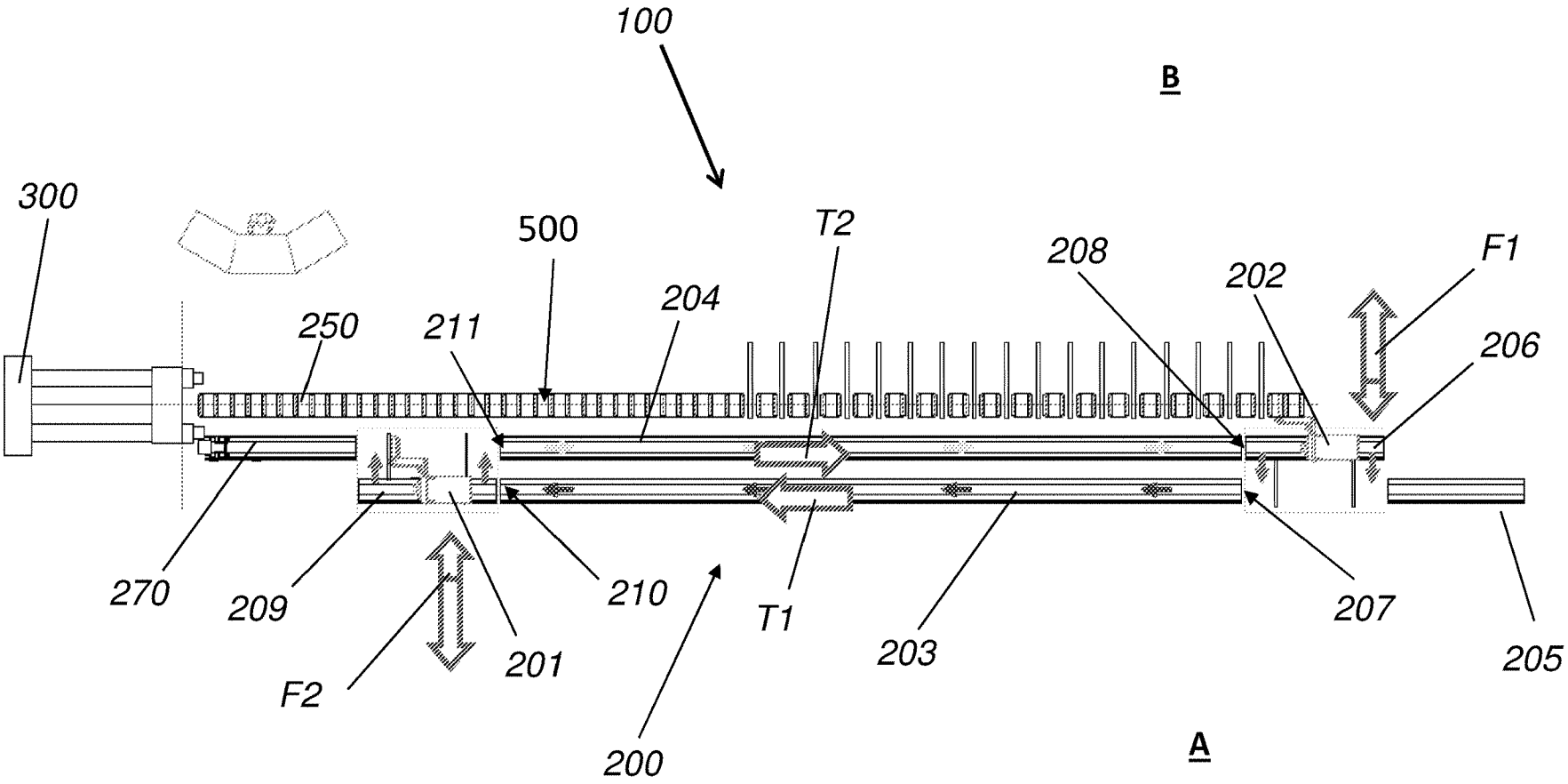
FIG. 1 shows a diagrammatic top view of an extrusion plant equipped with a system of pullers according to one embodiment of the present invention.

The present invention is particularly advantageously applicable in the field of extruding metals, in particular metal profiles, this being the reason why the present invention is clarified below with particular reference to the application thereof in the field of extruding metal profiles. Moreover, the possible applications of the present invention are not limited to the case of extruding metal profiles; contrarily, the present invention is just as advantageously applied in the field of generally moving objects, in particular metal objects.

The present invention is clarified below by means of the following detailed description of embodiments thereof depicted in the drawings. Moreover, however, the present invention is not limited to the embodiments described below and depicted in the drawings; contrarily, all those variants of the embodiments described below and depicted in the drawings, which are apparent to those skilled in the technical field, fall within the scope of the present invention.

Numeral 100 in FIG. 1 identifies a plant comprehensive of an extrusion press 300 and of a system of pullers 200 according to one embodiment of the present invention. In particular, system 200 comprises a first guide 203 and a second guide 204, said first 203 and second 204 guides being arranged parallel to each other and adjacent to the extrusion line (or axis) along which the profiles P (FIG. 2) are extruded by press 300. A plurality of rolls 250 (substantially known and therefore not described in detail for reasons of brevity) for supporting profiles is prepared at the extrusion line and therefore in position adjacent to the second guide 204.

The guides 203 and 204 are physically and mechanically separate and both anchored to the ground (FIG. 2), each in an independent manner of the other. Thereby, the vibrations for each guide induced by the movement of the puller are absorbed/unloaded by/onto the ground without being transmitted to the other guide.

Namely, the two guides 203, 204 are placed side-by-side and are arranged on the same side (that is in the same half-space) with respect to the above-indicated line (or extrusion axis), as clearly visible in the diagram in FIG. 1. Letters A and B in this diagram identify the two half-spaces identified by the extrusion axis 500. In particular, the two guides 203, 204 are placed in the same half-space A, but in an alternative embodiment, they could be arranged placed side-by-side in the same half-space B.

Figure 2:
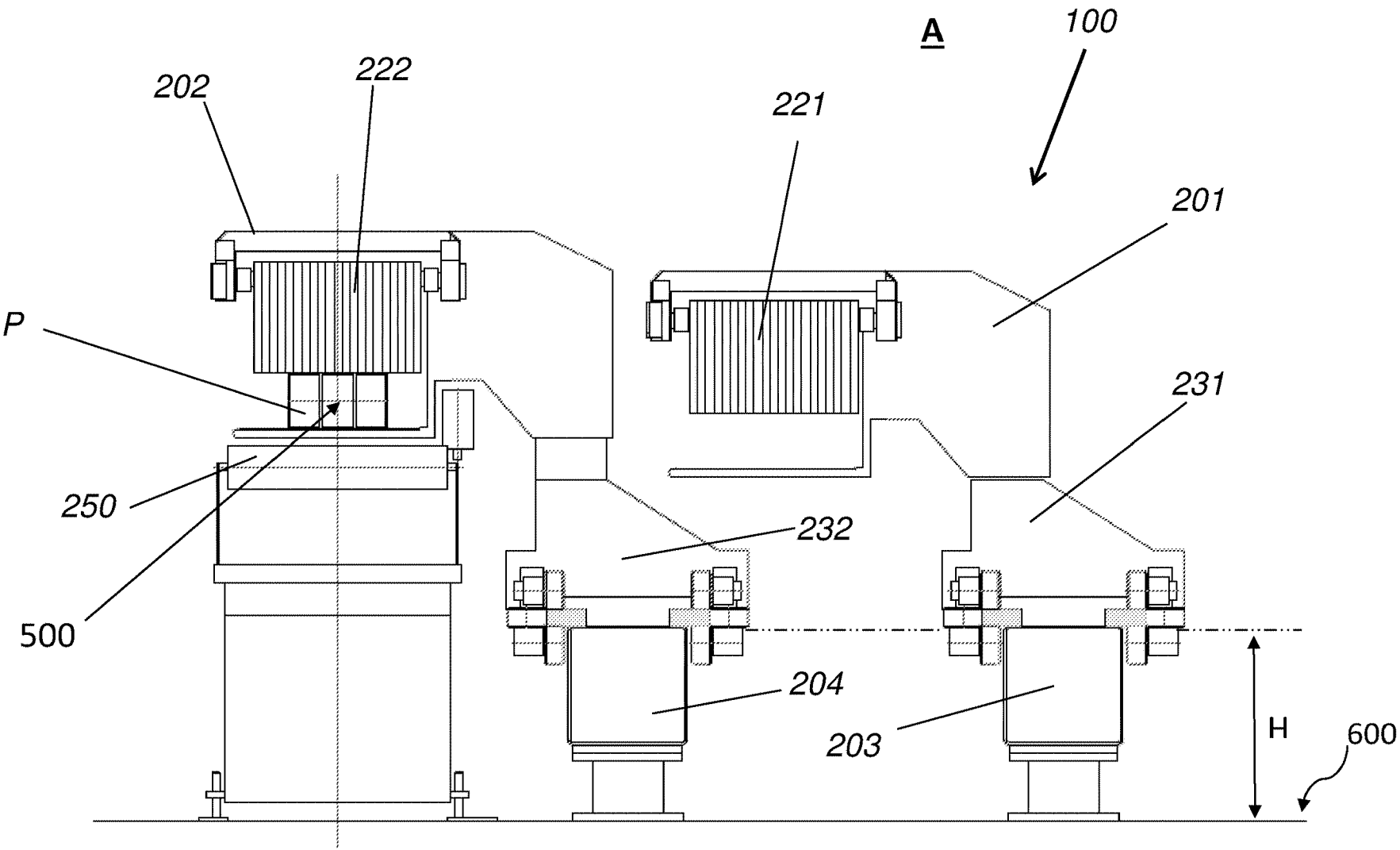
FIG. 2 shows a diagrammatic cross-sectioned view of a system of pullers according to one embodiment of the present invention.

According to a possible embodiment, the two guides 203, 204 have the same height with respect to a substantially horizontal reference plane. In this regard, the height H of the two guides 203, 204 assessed with respect to a horizontal plane 600 substantially at ground level is indicated in FIG. 2. In an alternative embodiment, the two guides 203, 204 could have a different height with respect to the reference plane considered.

In any case, according to the invention, the two guides 203, 204 are not vertically overlapping, that is to say one guide is not placed above the other guide with respect to the vertical direction.

A first puller 201 and a second puller 202 can be translated along the guides 203 and 204 according to the methods and/or peculiarities of the present invention described in greater detail below. The translation of the pullers 201 and 202 along the guides 203 and 204, as well as along further guides (see the following description) is obtained by means of substantially known methods which do not necessarily fall within the scope of the present invention; for example, both remote drives and individual drives on board each of the pullers 201, and 202 and/or of the respective carriages (see the following description) may be provided. For example, in the case of remote drive, a geared motor mounted (for example) on the ground at one of the ends of each guide or travel path may be provided, where here the puller is pulled in two opposite directions by means a closed-loop drive element, for example a belt, a chain, a cable or similar element. Moreover, there is at least one pulley and possibly also an element adapted to tension the drive element, and that is the chain or cable or belt or similar element, at both ends of each guide, where at least one of the two pulleys is connected to the geared motor to allow the transmission of the motion to the puller.

In the case instead of on-board drive, a geared motor or a linear motor that moves integrally with the puller itself may be for example, installed on each puller, where in this case the linear movement of the puller along the guides may be obtained by means of a pinion and rack system or with a pinion and fixed chain or also by friction by means of at least one drive wheel. In the case of a pinion and rack system, the pinion is mounted on the reducer while the rack is fastened to the guide. Instead in the chain system, the chain is fastened to the ends of the guide and is engaged in rotation by a pinion mounted on the shaft of the geared motor.

Moreover, the solution of both the remote and the on-board type of drive does not fall within the peculiarities of the present invention, the present invention being susceptible to being equipped and/or integrated with any solution among those available to those skilled in the art and known in the field.

As depicted in FIG. 1, in the case of the first guide 203, a first end portion 210 and a second end portion 207 opposite to the first may be identified, where likewise, in the case of the second guide 204, a first end portion 211 and a second end portion 208 opposite to the first and 211 may be identified. Moreover, the reference numeral 205 identifies a parking guide, which modes of use are clarified in detail below. Finally, reference numeral 206 identifies a repositioning guide arranged at the ends 207 and 208 of the guides 203 204, respectively, opposite to press 300, while the reference numeral 209 identifies a further repositioning guide arranged at the ends 210 and 211 of the guides 203 and 204, respectively.

As indicated by the dual arrow F2 in FIG. 1, the peculiarity of the repositioning guide 209 is that of being repositionable between a first position at the end 210 of guide 203, and a second position at the end 211 of guide 204, where guide 209, in the first position, defines and forms a continuous path with guide 203, and where therefore the pullers 201 and 202 may translate from guide 203 to guide 209 and vice versa, and where, in corresponding manner, guide 209, in the second position, defines a continuous path with guide 204, whereby the pullers 201 and 202 may translate both from guide 204 to guide 209 and from guide 209 to guide 204.

Likewise, as indicated by the dual arrow F1 in FIG. 1, the peculiarity of the repositioning guide 206 is that of being repositionable between a first position at the end 207 of guide 203, and a second position at the end 208 of guide 204. Guide 206, in the first position, defines and forms a continuous path with guide 203. The pullers 201 and 202 may translate from guide 203 to guide 206 and vice versa. In corresponding manner, guide 206, in the second position, defines a continuous path with guide 204, whereby the pullers 201 and 202 may translate both from guide 204 to guide 206 and from guide 206 to guide 204.

According to one embodiment, at least one of the repositioning guides 206, 209 is moved/repositioned between the corresponding first position and the corresponding second position through a translation which occurs on a substantially horizontal plane and according to a transverse direction which is substantially orthogonal to the extrusion line 500. This transverse direction is identified in FIG. 1 by arrows F1 and F2. The translation in transverse direction may be obtained for example, through actuators which move the corresponding repositioning guide in the two directions according to the position (first or second) that the same should occupy.

With reference to FIG. 2, it is also possible to appreciate that the pullers 201 and 202 comprise respective carriages 231 and 232 provided with anchoring means (not described in detail) for anchoring to the respective guides 203 and 204. Within the scope of the present invention, said anchoring means may comprise solutions of known type (and therefore not described in detail) such as for example, roll systems which engage tracks of the guides 203 and 204. Moreover, the carriages 231 and 232 support respective gripping means 221 and 222 adapted to be operated in such a manner so as to engage and grip the end of a profile P, for example an extruded profile P exiting from the extrusion press 300, also in this case according to modes of substantially known type.

The operating and/or using modes of the system of pullers 200 according to the embodiment of the present invention depicted in the drawings and described above may be substantially summarized as follows.

The starting configuration provides for the repositioning guide 209 to be in the position in which it defines a continuous path with guide 204 and for the repositioning guide 206 to be in the position in which it defines a substantially continuous path with guide 203, the pullers 201 and 202 being positioned on the repositioning guide 209 and on the repositioning guide 206, respectively. At this point, the gripping means 221 of puller 201 are positioned (for example, translated in vertical direction) so as to engage the end of profile P at the outside of press 300 and finally are engaged and gripped on said end of profile P. Puller 201 is then translated away from press 300 (from left to right in FIG. 1), and therefore in the direction indicated by arrow T2, thereby exerting the desired traction on the profile extruded by press 300. Puller 201 then moves from the repositioning guide 209 to guide 204. During the translation of puller 201 away from press 300, puller 202 is translated to approach press 300, and therefore in the direction indicated by arrow T1, first along the repositioning guide 206 and then along guide 203. Moreover, during the translation of the pullers 201 and 202 along guide 204 and guide 203, respectively, the repositioning guides 209 and 206 are repositioned, where guide 209 is arranged at the end 210 of guide 203 so as to define a substantially continuous path with guide 203, while the repositioning guide 206 is arranged at the end 208 of guide 204, and therefore so as to define a substantially continuous path with guide 204.

Once a predefined first position is reached by puller 201, profile P is cut at a predetermined length L. Such a length L corresponds to the distance between the end of the profile, close to which the gripping means 221 are engaged, and the position of the cutting means. Then, profile P having length L is dragged by puller 201 along the system of rolls up to a predefined second position for the release. At this point, the gripping means 221 are disengaged from the end of profile P.

Said predefined second position of puller 201 may be both on guide 204 and on guide 206; and in any case, whatever said predefined second position, puller 201 (whether it is already disengaged from the profile or is still engaged on the profile itself) is translated up to the repositioning guide 206, while puller 202 is translated up to the repositioning guide 209. At this point, the cycle may start over by repositioning guide 209 at the end 211 of guide 204 and guide 206 at the end 207 of guide 203, and may therefore continue according to the modes described above, where in this case it is puller 202 to act in traction on the profile (and therefore to perform the pulling step) while puller 201 is translated to approach press 300, thereby performing the return step.

It is therefore apparent from that disclosed above that each of the two guides 203 and 204 is solely dedicated to one and one only of the two "pulling" and "return" steps; this means that both the pullers 201 and 202 on guide 204 are translated solely and exclusively in the translation direction T2, away from press 300, where the pullers 201 and 202 on guide 203 are translated solely and exclusively in the translation direction T1, approaching press 300.

Reference numeral 205 in FIG. 1 identifies a further peculiarity of the present invention, that is to say a further guide (called a parking guide) and adapted to house one or more pullers in a stopped status and so as not to hinder the translation of the remaining pullers during the pulling and return steps. In the particular example in FIG. 1, the parking guide 205 is arranged in axis with guide 203, where therefore a puller 201 or 202 may be translated onto guide 205 by means of preventive positioning of the repositioning guide 206, in particular at the end 207 of guide 203. Guide 205 may in any case also be positioned in axis with guide 204, where more than one parking guide may also be provided. The parking guides (one or more than one) allow facilitating the maintenance operations of the pullers, where for example, a puller to be checked and/or repaired may be translated onto a parking guide, and where the parking guides may also be used for actually parking pullers to be used in the case for example, of failure of a puller among those employed and used.

Reference numeral 270 in FIG. 1 identifies a guide (called an extension guide) which is aligned with guide 204 in a position interposed between guide 204 and press 300. The purpose of the extension guide 270 is to allow one of the two pullers to reach a position close to press 300 during the first extrusion. Thereby, the gripping means 221 may engage the end of profile P as soon as it is formed, that is to say in a position substantially corresponding to the outlet section of press 300 from which the profile itself exits.

It has therefore been shown by the detailed description above of the embodiments of the present invention depicted in the drawings, that the present invention allows the preset objects to be obtained while overcoming the drawbacks encountered in the prior art.

In particular, the present invention relates to the installation and use of constructionally different guides, each of the guides being dedicated to a single pulling or returning step, where the guide dedicated to the return step may be constructively simpler and therefore less costly both from a constructional and installation viewpoint as well as from the viewpoint of maintenance.

In reference to the guides, contrarily to what occurs in solutions of known type, a mechanical division among the travel paths (guides) substantially is achieved through the present invention, which advantageously prevents the transmission of vibrations generated by the puller traveling the return path (guide 203) to the puller traveling the outward path (guide 204). In essence, the puller that drags profile P does not suffer the behavior of the puller that returns towards the repositioning guide 209 in favor of the quality of the extruded profile P.

Moreover, the present invention allows the installation and use of substantially identical or at least very similar pullers from a constructional viewpoint, the problems of mutual interference between the pullers being avoided by means of the present invention, and therefore the need to provide at least one of the pullers with solutions for moving and repositioning gripping means, in particular during the return step.

Substantially identical or at least very similar pullers from a constructional viewpoint also allow reducing the hours and energy or resources dedicated to design, decreasing the components of the carriages and the related assembly complexity, and decreasing the spare parts, with apparent advantages also from a logistics viewpoint.

The system according to the present invention also allows simultaneously using more than two pullers and therefore speeding up the movement of the profiles, in particular the extrusion process. Moreover, the system may be kept running by means of the parking guides while simultaneously providing for the maintenance and/or repair of the parked pullers. Finally, one or more reserve pullers that may be put into operation according to simple and immediate modes may be prepared in the case of particular production needs and/or malfunctioning or failure of one of the other pullers. Again, in the case of extrusion plants with more than one extrusion press, the pullers may be repositioned from one to the other of the various guides with the same system of pullers and so as to meet any production need.

Although the present invention was clarified by means of the preceding detailed description of the embodiments thereof depicted in the drawings, the present invention is not limited to the embodiments described above and depicted in the drawings. Contrarily, all those modifications and/or variants of the embodiments described above and depicted in the drawings, which are obvious and apparent to those skilled in the art, fall within the scope of the present invention.

For example, as anticipated, the number of pullers may vary according to the needs and/or circumstances, in particular both those operating and those "parked" and/or reserved. Likewise, according to the needs and/or circumstances, both the number and position of the repositioning and/or parking guides may vary. Moreover, the guides may be both anchored to the ground and suspended. Again, concerning the movement of the pullers, both remote and on-board drives may be provided. And finally, the broadest selection is allowed—within the scope of the present invention—concerning the solutions which may be implemented for moving the repositioning guides, which in the case of systems with particularly contained costs, may also provide manually moving the repositioning guides. The same may be said concerning the repositioning times, where the repositioning guides may be repositioned according to times dictated by the particular needs and/or circumstances.

The scope of the present invention is thus defined by the claims.

The invention claimed is:

1. A system of pullers for a plant for extruding metals along an extrusion line, said system comprising:

at least a first puller and a second puller, each adapted to engage and grip an end portion of an extruded profile (P) exiting from an extrusion press and supported by a plurality of rolls provided on the extrusion line;

a first guide and a second guide arranged adjacent to the extrusion line, wherein said first and second pullers can be translated along said first and second guides without contacting the plurality of rolls that support the extruded profile (P), wherein said first guide is dedicated to the translation of both said first and second pullers in a single first translation direction (T1), wherein said second guide is dedicated to the translation of both said first and second pullers in a second translation direction (T2) opposite to said first translation direction (T1), wherein said first and second pullers can be translated along parallel directions along said first and second guides; and means for repositioning both of said first and second pullers from said first guide to said second guide and from said second guide to said first guide, wherein said guides are separate from each other, are placed side-by-side, are not overlapping and are both anchored to the ground on a same side with respect to an extrusion line along which said profile (P) is extruded, wherein said guides are positioned at the same height assessed with respect to a horizontal reference plane, are physically and mechanically separate and both anchored to the ground each in an independent manner of the other, whereby vibrations of each of said guides induced by the movement of said pullers are absorbed by or unloaded onto the ground without being transmitted to the other guide; and a parking guide intended to house at least one of said first and second pullers in a stopped status and so as not to hinder translation of a remaining one or more pullers of said first and second pullers along the first and second guides, wherein said means for repositioning comprise at least a first repositioning guide which can be repositioned alternatively between a first position at a first end portion of said first guide and a second position at a first end portion of said second guide adjacent to said first end portion of said first guide, wherein, with said first repositioning guide in said first position, said first guide, said first repositioning guide, and said parking guide define a continuous horizontal translation path such that said first and second pullers can be translated along said first guide, along said first repositioning guide, and along said parking guide, and wherein, with said first repositioning guide in said second position, said second guide and said first repositioning guide define a continuous horizontal translation path such that said first and second pullers can be translated both along said second guide and along said first repositioning guide.

2. The system according to claim 1, wherein said means for repositioning comprise a second repositioning guide which can be repositioned alternatively between a first position at a second end portion of said first guide and a second position at a second end portion of said second guide adjacent to said second end portion of said first guide, wherein, with said second repositioning guide in said first position, said first guide and said second repositioning guide define a continuous translation path such that said first and second pullers can be translated both along said first guide and along said second repositioning guide, and wherein, with said second repositioning guide in said second position, said second guide and said second repositioning guide define a continuous translation path such that said first and second pullers can be translated both along said second guide and along said second repositioning guide.

3. The system according to claim 2, wherein said first and second repositioning guides can be moved by translation along a translation direction different from an extension direction of said first and second guides.

4. The system according to claim 1, wherein said system comprises an extension guide aligned with one of said guides and interposed between said one of said guides and said press, wherein said extension guide is configured so that one of said pullers reaches a position closer to said press during extrusion of said profile (P) than could be reached using said one of said guides without said extension guide.

5. The system according to claim 4, wherein each of said first and second pullers comprises a main frame or carriage.

6. A plant for extruding metal profiles (P), said plant comprising an extrusion press and a system of pullers for moving in traction an extruded product (P) exiting from said extrusion press, characterized in that said system of pullers is the system of pullers according to claim 1.

7. The system according to claim 1, wherein said parking guide is arranged in axis with said first guide.

8. A system of pullers for a plant for extruding metals along an extrusion line, said system comprising:

at least a first puller and a second puller, each adapted to engage and grip an end portion of an extruded profile (P) exiting from an extrusion press and supported by a plurality of rolls provided on the extrusion line;

a first guide and a second guide arranged adjacent to the extrusion line, wherein said first and second pullers can be translated along said first and second guides without contacting the plurality of rolls that support the extruded profile (P), wherein said first guide is dedicated to the translation of both said first and second pullers in a single first translation direction (T1), wherein said second guide is dedicated to the translation of both said first and second pullers in a second translation direction (T2) opposite to said first translation direction (T1), wherein said first and second pullers can be translated along parallel directions along said first and second guides; and means for repositioning both of said first and second pullers from said first guide to said second guide and from said second guide to said first guide, wherein said guides are separate from each other, are placed side-by-side, are not overlapping and are both anchored to the ground and arranged on a same side with respect to an extrusion line along which said profile (P) is extruded, are physically and mechanically separate and both anchored to the ground each in an independent manner of the other, whereby vibrations of each of said guides induced by the movement of said pullers are absorbed by or unloaded onto the ground without being transmitted to the other guide; and a parking guide intended to house at least one of said first and second pullers in a stopped status and so as not to hinder translation of a remaining one or more pullers of said first and second pullers along the first and second guides, wherein said means for repositioning comprise at least a first repositioning guide which can be repositioned alternatively between a first position at a first end portion of said first guide and a second position at a first end portion of said second guide adjacent to said first end portion of said first guide, wherein, with, said first repositioning guide in said first position, said first guide, said first repositioning guide, and said parking guide define a continuous horizontal translation path such that said first and second pullers can be translated along said first guide, along said first repositioning guide, and along said parking guide, and wherein, with said first repositioning guide in said second position, said second guide and said first repositioning guide define a continuous horizontal translation path such that said first and second pullers can be translated both along said second guide and along said first repositioning guide.

9. The system according to claim 8, wherein said guides are positioned at the same height assessed with respect to a horizontal reference plane.

10. The system according to claim 8, wherein said means for repositioning comprise a second repositioning guide which can be repositioned alternatively between a first position at a second end portion of said first guide and a second position at a second end portion of said second guide adjacent to said second end portion of said first guide, wherein, with said second repositioning guide in said first position, said first guide and said second repositioning guide define a continuous translation path such that said first and second pullers can be translated both along said first guide and along said second repositioning guide, and wherein, with said second repositioning guide in said second position, said second guide and said second repositioning guide define a continuous translation path such that said first and second pullers can be translated both along said second guide and along said second repositioning guide.

11. The system according to claim 10, wherein said first and second repositioning guides can be moved by translation along a translation direction different from an extension direction of said first and second guides.

12. The system according to claim 8, wherein said system comprises an extension guide aligned with one of said guides and interposed between said one of said guides and said press, wherein said extension guide is configured so that one of said pullers reaches a position closer to said press during extrusion of said profile (P) than could be reached using said one of said guides without said extension guide.

13. The system according to claim 12, wherein each of said at first and second pullers comprises a main frame or carriage.

14. A plant for extruding metal profiles (P), said plant comprising an extrusion press and a system of pullers for moving in traction an extruded product (P) exiting from said extrusion press, characterized in that said system of pullers is the system of pullers according to claim 8.

15. The system according to claim 8, wherein said parking guide is arranged in axis with said first guide.

* * * * *